United States Patent [19]

Kalnin et al.

[11] 4,141,411

[45] Feb. 27, 1979

[54] TUBULAR HEAT EXCHANGER

[76] Inventors: Igor M. Kalnin, Kropotkinskaya ulitsa, 26, kv. 13; Vladimir N. Krotkov, ulitsa Chkalova, 24/32, kv. 132, both of Moscow; Taisia M. Sutyrina, ulitsa Sportivnaya, 3, kv. 54, Lytkarino Moskovskoi oblasti; Anna N. Sergeeva, ulitsa Krivorozhskaya, 23, korpus 1, kv. 90; Oleg A. Sergeev, Zhigulevskaya ulitsa, 12, korpus 2, kv. 75, both of Moscow, all of U.S.S.R.

[21] Appl. No.: 663,530

[22] Filed: Mar. 3, 1976

[30] Foreign Application Priority Data

| | | | |
|---|---|---|---|
| Jun. 14, 1973 | [SU] | U.S.S.R. | 1930563 |
| Feb. 28, 1974 | [SU] | U.S.S.R. | 1997278 |
| May 14, 1974 | [SU] | U.S.S.R. | 2019578 |

[51] Int. Cl.[2] ..... F28F 1/10

[52] U.S. Cl. ..... 165/151; 165/181; 29/157.3 B

[58] Field of Search ..... 165/150, 151, 152, 181–183

[56] References Cited

U.S. PATENT DOCUMENTS

| | | | |
|---|---|---|---|
| 1,730,719 | 10/1929 | Briskin | 165/152 |
| 2,217,469 | 10/1940 | Clarke | 165/181 |
| 3,223,153 | 12/1965 | Simpelaar | 165/181 |
| 3,224,503 | 12/1965 | Konanz | 165/183 |
| 3,437,134 | 4/1969 | Oddy | 165/151 |
| 3,645,330 | 2/1972 | Albright et al. | 165/151 |
| 3,695,347 | 10/1972 | Chartet | 165/152 |

FOREIGN PATENT DOCUMENTS

| | | | |
|---|---|---|---|
| 1212901 | 10/1959 | France | 165/151 |
| 1457587 | 9/1966 | France | 165/181 |
| 1218635 | 1/1971 | United Kingdom | 165/151 |

*Primary Examiner*—Charles J. Myhre
*Assistant Examiner*—T. W. Streule
*Attorney, Agent, or Firm*—Haseltine, Lake & Waters

[57] ABSTRACT

A heat exchanger includes ribs mounted transversely of the axis of the tube and uniformly spaced therealong. Each rib includes a plate with corrugations oriented along the flow of the fluid washing the tube. The ribs adjoin one another, their corrugations having lateral slits, the wall portions between these slits being offset relative to one another to provide passages for the flow of the fluid.

Owing to this structure the thickness of the boundary layer at each one of said portions is reduced, and the effectiveness of heat exchange is stepped up. Furthermore, a heat exchanger with the disclosed ribs is considerably more compact and needs less metal for its construction, as compared with known heat exchangers.

4 Claims, 21 Drawing Figures

C
K

TUBULAR HEAT EXCHANGER

This is a continuation, of application Ser. No. 479,264 now abandoned filed June 13, 1974.

FIELD OF THE INVENTION

The present invention relates to heat exchange apparatus, and, more particularly, it relates to tubular heat exchangers.

The invention can be utilized in refrigerating machinery, viz. in air-cooled condensers and in air coolers.

The present invention can be utilized to utmost advantage in heat exchange apparatus wherein the heat exchanging fluids have considerably differing heat transfer factors, such as, for instance, a condensing coolant having a heat transfer factor within a range from 2000 to 4000 kcal/hour.m$^2$.° C. and air having a heat transfer factor within a range from 40 to 50 kcal/-hour. m$^2$.° C. In such cases it is necessary that the heat exchangers should have a heat exchange area contacted by the air, which is considerably greater than the area contacted by the coolant.

PRIOR ART

There are known heat exchangers of the plate and rib type, including plain solid plates separating the heat exchanging fluids and corrugated ribs or fins mounted between these plates. Heat exchangers of this type feature developed heat exchange surfaces contacting both fluids, whereby they are predominantly used as gas-to-gas, or else as liquid-to-liquid heat exchangers wherein the heat transfer factors of both fluids are equally relatively low.

In the case of heat exchangers having to deal with a pair of fluids having considerably differing heat transfer factors the use of the plate and rib type structure is ill-advisable, since in this case the heat exchange area contacting one of the fluids, i.e. the one having a great heat transfer factor, is far too great for practical reasons. Furthermore, in heat exchangers of the plate and rib type the two fluids are separated by a flat wall, and, therefore, the use of such heat exchangers is limited to the range of relatively low pressures. Heat exchangers of the plate and rib type are difficult to manufacture, and their cost is comparatively high. Their manufacture involves soldering in salt baths, or else in special-design furnaces with the use of solders that are incompatible with some of the fluids. Structures of the plate and rib type cannot be used in cases of fluids containing impurities which necessitate regular washing and cleaning of the apparatus.

There is widely known a heat exchanger including at least one tube having ribs mounted perpendicularly to the axis of the tube and uniformly spaced therealong, the tube being positioned to encounter a flow of a fluid directed laterally of the axis of the tube.

In heat exchangers of this kind there flows through the tubes a fluid which is either liquid, or condensing, or boiling, whereas either air or some other gaseous fluid is blown by a fan through passages defined by the ribs. Heat is transferred through the walls of the tube and the ribs either from the fluid flowing through the tubes to the gas, or vice versa. The greater the difference between the heat transfer factors of the two fluids, the greater should be the area of the ribs, i.e. either the ribs should be spaced more closely, and their number per unit of the length of the tube should be greater, or with the same spacing the area of each rib should be greater, or both. Heat exchangers of this known kind are employed, e.g. in aircooled condensers, with the ribbing degree within a range from 20:1 to 25:1. These condensers are comparatively bulky and, in fact, determine the dimensions of and the quantity of metal in the refrigerating machine, as a whole, which is particularly true of machines with a great refrigeration capacity, incorporating screw and centrifugal compressors. For such machines reduction of the dimensions and weight of the condensers is an important task.

In widely employed heat exchangers there are used plain ribs, fluted ribs of increased rigidity and ribs of specific profiles having projections and grooves of various shapes. All these ribs are solid ones, the side walls of the fluted portions, of the projections and grooves having no slits and not occupying the entire space intermediate of the ribs.

Among the disadvantages of the structure of the known kind of heat exchangers is the fact that in this structure the area of the ribs can be increased either by increasing the dimensions thereof or by reducing the spaces between the ribs and increasing their quantity. In the first case the overall dimensions of the apparatus are considerably increased, whereas in the second case its manufacture becomes more complicated.

Another disadvantage of the known structure is the relatively great resistance to heat transfer from the gaseous fluid, since the longer is the length of the rib longitudinally of the flow of the fluid, the thicker becomes the boundary layer resisting heat exchange between the fluids.

Moreover, when the tube is washed by the flow of the gaseous fluid, there are encountered considerable values of flow resistance, whereby the gaseous fluid is non-uniformly distributed in the passages intermediate of the ribs, and the major part of the flow of the fluid passes adjacent to the peripheral margins of the ribs, which yields inadequately effective heat exchange. This is also a disadvantage of the known structure.

Still another disadvantage of the known structure is the fact that when an apparatus with relatively closely spaced ribs is employed, the passages intermediate of the ribs might become clogged. Since the passages are separated from one another by solid ribs, the flow cannot be redistributed therebetween, and the entire passage becomes inoperative. Consequently, the heat transfer area is reduced, and the effectiveness of the performance of the heat exchanger, as a whole, is affected.

Yet another disadvantage of the known structure of heat exchangers arises from the necessity of using specific devices during their manufacture to set the ribs on the tube with the required spacing.

SUMMARY OF THE INVENTION

It is an object of the present invention to provide a structure of a tubular heat exchanger, which should either offer considerably increased area of heat transfer from the fluid with the lower heat transfer factor without increasing the overall dimensions of the apparatus, or else which should enable to reduce the overall dimensions of a heat exchanger without reducing the area of heat transfer.

It is another object of the present invention to provide a tubular heat exchanger of a structure providing for uniform and optimal, from the point of view of heat transfer, distribution of the flow of the fluid throughout the passages intermediate of the ribs.

It is still another object of the present invention to provide a tubular heat exchanger, providing for uniform distribution of the flow among the passages intermediate of the ribs and having its performance practically unaffected by clogging of certain of the portions of these passages.

It is a further object of the present invention to provide a tubular heat exchanger of a structure enabling to eliminate the use of specific devices for retaining the ribs at a required spacing at manufacture of the heat exchanger.

These and other objects are attained in a tubular heat exchanger including at least one tube with ribs supported thereon perpendicularly to the axis of the tube and uniformly spaced therealong, the tube being positioned to encounter a flow of a fluid directed transversely of the axis of the tube, in which heat exchanger, according to the present invention, each said rib is a plate with corrugations arranged at both sides of the tube along the flow of the fluid, these corrugations having transverse slits, the portions of the walls between these slits being offset relative to one another in a direction transverse to these corrugations to afford passages for the flow of the fluid, the ribs adjoining one another.

In a heat exchanger of the herein disclosed structure the side walls of the corrugations practically span the entire width of the passages intermediate of the ribs, and, therefore, the heat transfer area is increased without the overall external dimensions of the heat exchanger being increased, which means that the apparatus becomes more compact.

Furtheremore, the side walls of the corrugations increase the heat exchange perimeter of the flow area afforded to the fluid, the hydraulic diameter of this flow area being at the same time reduced, which steps up the effectiveness of heat transfer. The provision of the slits and of the portions of the walls of the corrugations, that are offset relative to the other portions thereof further steps up the effectiveness of heat transfer. Moreover, firstly, the thickness of the boundary layer of the flow of the fluid on the surface of the rib is reduced, this boundary layer being the major opponent of heat transfer. This is due to the fact that the thickness of the boundary layer grows, as the flow moves along the surface of the rib; hence, the longer the rib, the thicker this boundary layer. Since, in accordance with the invention, the corrugations of the rib are subdivided into short portions, the mean thickness of the boundary layer on these short portions is reduced. Secondly, there is effected intense mixing of the particles of the fluid which are now within a layer adjoining the wall and thereafter within the core of the flow; and, thirdly, there takes place turbulization of the flow, as it leaps at the slits off the portions of the walls of the corrugations. All these factors amount to considerably enhanced effectiveness of heat transfer, as the fluid flows along a rib.

The provision of the ribs with corrugations somewhat spaced from the tube and having the slits and offset walls brings about more rational, from the point of view of heat transfer, distribution of the flow of the fluid along the passages defined by the tube and the ribs. The corrugations with the slits and the offset wall portions are responsible for higher resistance to the flow of the fluid at the areas of these corrugations, i.e. the areas relatively remote from the tube, whereby the flow rate of the gas, e.g. air along the plain portions of the ribs, adjoining the tube, is increased, and the so-called dead zone formed by the flow impinging on the tube is reduced. It should be remembered that these very portions of the ribs, adjoining the tube offer the most effective heat transfer.

The provision of the slits in the ribs and of the offset wall portions intermediate of these slits ensures mor uniform distribution of the flow among all the passages between the ribs mounted on the tube, irrespectively of eventual local areas of increased flow resistance along some of the portions of these passages, e.g. caused by these portions having been clogged with impurities. The slits and the offset wall portions in fact establish communication between all the inter-rib passages and enable the flow to by-pass the clogged portions of these passages. The surface of heat exchange of the clogged passages in this case does not become completely inoperative, and, therefore, the performance of the heat exchanger is practically unaffected by clogging of certain portions of the passages intermediate of the ribs.

With the side walls of the corrugations spanning the entire width of the fluid flow passages, this, in addition to providing for compactness of the exchanger, also enables to arrange the ribs on the tube at the required spacing without any specific manufacture steps and devices.

It is expedient that the plain portions of the rib, intermediate of the corrugations, should have slits made therein transversely of the flow of the fluid washing the tube, and that the edges of these slits should be bent away in opposite directions from the general plane of these portions, the slits extending substantially radially of the tube.

With the last-mentioned slits arranged and extending in the specified manner, the effectiveness of heat transfer by the entire surface of the ribs is additionally stepped up, due to intensification of heat transfer at the plain portions of each rib. This intensification of heat transfer is attained as a result of turbulization of the flow by the bent away edges of the slit and of intense agitation of the flow.

It is further expedient that the portions of each rib in the valleys intermediate of the corrugations should likewise have slits cut therein transversely of the flow of the fluid, and that the edges of these slits should be bent away in opposite directions from the plane of these portions.

In this way the effectiveness of heat transfer is further increased.

According to one of the embodiments of the present invention the corrugations are arranged to one side of the plane of the rib, their side walls being perpendicular to the plane of the rib, and the slits being cut in the apexes of the corrugations.

As compared with a plain rib, the surface of the rib of the abovementioned embodiment, having the same dimensions, offers a greater operative area, due to the side walls of the corrugations and to the curving of the apexes, as their portions intermediate of the slits are offset. This also increases the effectiveness of heat exchange.

According to another embodiment of the present invention the slits are cut in the side walls of the corrugations, the latter being arranged to one side of the plane of the rib.

It is expedient to use the last-mentioned structure of the ribs when the spacing therebetween is relatively great, so as to intensify heat transfer at the surface of the side walls, which in this case constitutes a considerable part of the entire heat exchange surface and is increased, due to the curving of the portions of the side walls, as these portions are offset. With relatively great spacing of the ribs, the compactness of a heat exchanger with slits in the side walls of the corrugations and the effectiveness of heat transfer by the entire surface are greater than in a structure with slits in the apexes of the corrugations.

According to yet another embodiment of the present invention the slits are through ones, passing both through the apexes and through the side walls, the portions intermediate of the slits being offset relative to one another so that each portion has one side wall perpendicular to the plane of the rib and situated to one side of the latter.

A rib of this kind is advisable to use when the degree of the ribbing is comparatively small, within a range from 15 to 20.

Still another embodiment of the present invention is characterized in that the corrugations are arranged to both sides of the plane of the rib, the slits in the corrugations being through ones and passing through the apexes and side walls of the corrugations.

Ribs of this last-mentioned kind are advisable to use with relatively great spacing of the ribs and when the fluids being handled contain a high percentage of impurities, provided the requirements as to the compactness of the apparatus are not the most important ones.

When it is essential that the heat exchanger should be as compact as possible and the degree of the ribbing is relatively great, it is expedient to use ribs having corrugations arranged to both sides of the plane of the rib, the slits being through ones and passing through the apexes and side walls of the corrugations, the side walls being perpendicular to the plane of the rib and being offset at any two adjacent portions relative to each other in a direction parallel to the plane of the rib, the apexes of the corrugations belonging to the planes of the adjacent ribs.

A rib of this kind provides both for effectiveness of heat exchange and compactness of the heat exchanger; however, it requires a high accuracy at manufacture.

To render a heat exchanger in accordance with the invention still more compact, it is expedient that one rib should adjoin the adjacent one through an intermediate plate of which the portions situated between the side walls of each one of the corrugations have slits made therethrough transversely of the flow of the fluid, the edges of these slits being bent away in opposing directions from the plane of the rib.

The incorporation of an intermediate plate between the ribs considerably steps up the compactness of the heat exchanger with the ribs having the corrugations situated to both sides of the plane of the rib. With the intermediate plates having slits with bent away edges, heat exchange at the intermediate plate is intensified.

With the corrugations being arranged to only one side of the plane of the rib and with the incorporation of the intermediate plate, it is expedient, in order to render the structure more compact, and also to optimize the distribution of the fluid washing the tube and to step up the effectiveness of heat transfer, that the portions of the ribs between the corrugations at both sides of the tube should have slits made therethrough, having their edges bent in the same direction as the corrugations, to the same height as that of the side walls of the corrugations, these edges defining passages jointly with the respective intermediate plate, guiding the flow of the fluid.

In this case the edges of the slits, bent to the height of the corrugations, increase the heat exchange surface by the area of this bent edges, the guiding passages thus produced deflecting the flow in a manner minimizing the "dead" zones at the ribs adjacent to the tubes, whereby the effectiveness of heat exchange is increased.

With a structure incorporating the intermediate plate, it is expedient, in order to additionally intensify heat transfer, that the portions of the intermediate plate, corresponding to the portions of the rib between the corrugations, should have slits made therethrough transversely of the flow of the fluid washing the tube, the edges of these slits being bent away in opposite directions from the plane of the respective portion, the slits extending substantially radially of the tube.

The choice of either one of the abovedescribed embodiments of the invention is determined by the operating conditions of the heat exchanger and depends on the required rib spacing, the degree of ribbing, as well as on the available production facilities. The spacing of the ribs, in its turn, depends on the degree of purity of the fluid washing the ribbed tube and on the requirements as to the size of the heat exchanger. The degree of ribbing depends on the ratio of the factors of heat transfer of the two fluids.

BRIEF DESCRIPTION OF THE DRAWING

Given hereinbelow is a detailed description of several embodiments of the present invention, with reference being had to the accompanying drawings, wherein:

FIG. 2*a* is a perspective view of a portion of the heat exchanger shown in FIGS. 1 and 2;

DETAILED DESCRIPTION

Figure 1:
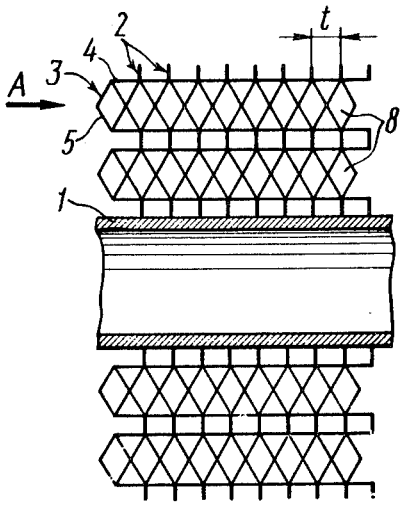
FIG. 1 is a longitudinal axial sectional view of a tubular heat exchanger with ribs embodying the invention.

Referring now in particular to the appended drawings, the tubular heat exchanger includes a tube 1 (FIG. 1) with ribs or fins 2 mounted perpendicularly to the axis of the tube 1 and uniformly spaced therealong. Each rib 2 is a plate whose width equals "a" and height equals "b" (FIG. 2), the plate supporting thereon corrugations 3 extending along the flow of the fluid medium washing in operation the tube 1 with the ribs 2. Similar ribs 2 may alternatively have two or even more apertures for tubes, in which case they are simultaneously fitted over two or more tubes 1. The ribs 2 are mounted on the tubes 1 and sealingly connected therewith by any known technique employed with the known plain solid ribs.

The side walls 4 (FIG. 1) of the corrugations 3 are rectilinear and extend perpendicularly to the plane of the rib 2. The corrugations 3 have apexes 5 through which transverse slits 6 are made. The portions 7 of the apexes 5 between the slits 6 are offset relative to one another in a direction transverse of the corrugation 3 and perpendicular to the plane of the rib 2. The extent of this offsetting of the portions 7 should be no less than 1.5 mm to 2.0 mm. The greater the distance between the offset portions 7 of the apexes 5 of the corrugations 3, the more compact the structure of the heat exchanger becomes. Since the ribs 2, in accordance with the invention, adjoin one another, the maximum extent of the offsetting is limited in the case of the portions 7 of the apexes 5 by the spacing "t" of the ribs 2, this spacing being selected to comply with the purity of the fluid medium washing the ribs, with the requirements as to the compactness of the heat exchanger and with the basic technological and economical calculations.

Figure 3:
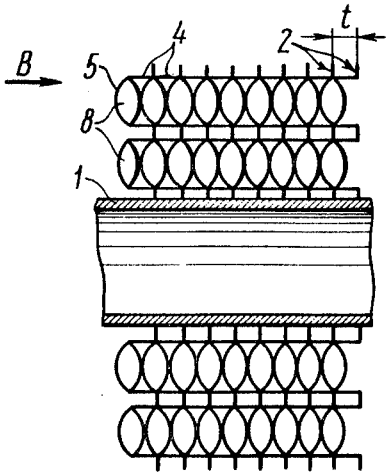
FIG. 3 is a longitudinal axial sectional view of a portion of a tubular heat exchanger having ribs representing an embodiment of the present invention.

The portions 7 of the apexes 5, offset relative to one another, are disposed to one side of the plane of the rib 2 and afford passages 8 for the flow of the medium, which in the presently described embodiment are diamond-shaped at the slits 6. However, depending on the actual technology of manufacture of the ribs 2, these passages may also be either oval or circular to render the structure of the heat exchanger even more compact, which can be seen in FIGS. 3 and 4.

As the gaseous medium flows along the surface of the walls of the corrugations 3 in operation of the heat exchanger, it leaps off these walls at the slits 6, and, since the length of the portions 7 of the corrugations 3 between the slits 6 is small enough (as small as 3 to 4 mm), the thickness of the boundary layer of the flow, which builds up with uninterrupted motion of the flow, is bound to be likewise small at the end of each portion 7. This small thickness of the boundary layer which is the major opponent to heat transfer determines the high effectiveness of heat transfer. Furthermore, as the flow leaps off the short portions 7 of the walls of the corrugations 3, it becomes turbulized, which promotes still further the effectiveness of heat transfer. As a result, the factor of heat transfer by the gaseous fluid at the corrugated portions of the ribs 2 is about two times greater than in the case of plain solid ribs.

Moreover, due to the action of the side walls 4 of the corrugations 3 and to the offset curving portions 7 of the apexes 5, in the presently described structure the same spacing of the ribs 2 yields a greater heat transfer perimeter of the flow area afforded to the fluid, than in the hitherto known structures, which brings down the value of the hydraulic diameter and further enhances the effectiveness of heat transfer.

Figure 2:
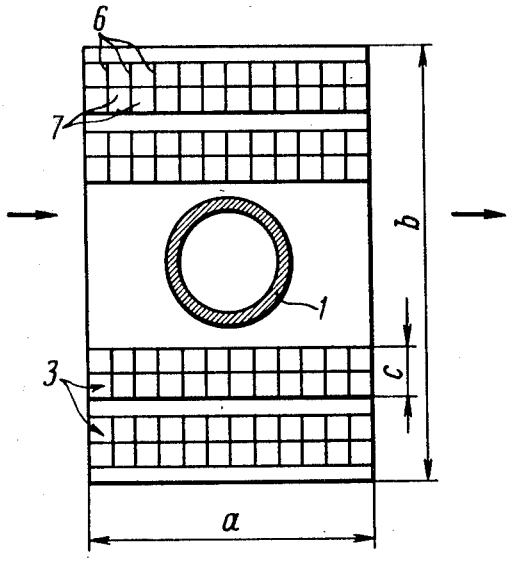
FIG. 2 is a view along arrow line "A" in FIG. 1.
Figure 4:
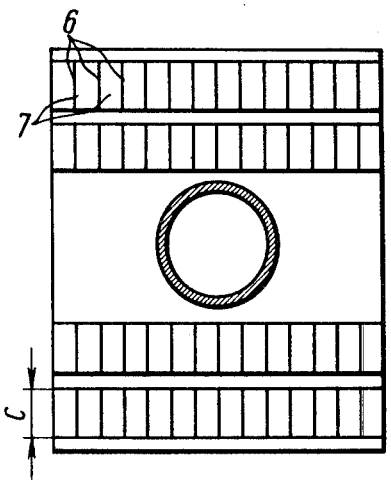
FIG. 4 is a view along arrow line "B" in FIG. 3.

In the case of the ribs 2 shown in FIGS. 2 and 4, with the width "c" of the corrugations 3 equalling the spacing "t" of the ribs 2 (FIGS. 1 and 3), the surface of the corrugated portions of the ribs 2 is increased about three times over, due to the surface of the side walls 4 of the corrugations 3. When the corrugated portions of the ribs 2 occupy about one half of the area of the rib 2 (FIGS. 2 and 4) in a plan view, i.e. "4 c − b/2", the compactness of the heat transfer surface contacting the gaseous medium is increased approximately two times. In the present disclosure the expression "compactness" refers to the total area of the heat exchange surface of the ribs 2 per unit of volume occupied by these ribs. With the portions 7 being of a semi-circular shape as a result of the offsetting, the surface of the apexes 5 of the corrugations 3 is increased by such offsetting T6 · C/2 · C times, i.e. 1.55 times. This corresponds to the total heat transfer surface of the rib being increased additionally 1.1 times. Thus, the total gain in compactness of the heat transfer surface, attained by the presently described embodiment in comparison with plain ribs arranged at the same spacing, is about 2.2 times.

Approximately the same gain is attained in the heat transfer perimeter of the flow area afforded to the gaseous medium, with corresponding reduction of the hydraulic diameter of the flow area. This means that the factor of heat transfer by the gaseous medium is increased by about 20 percent.

Figures 5, 6, 20, 21:
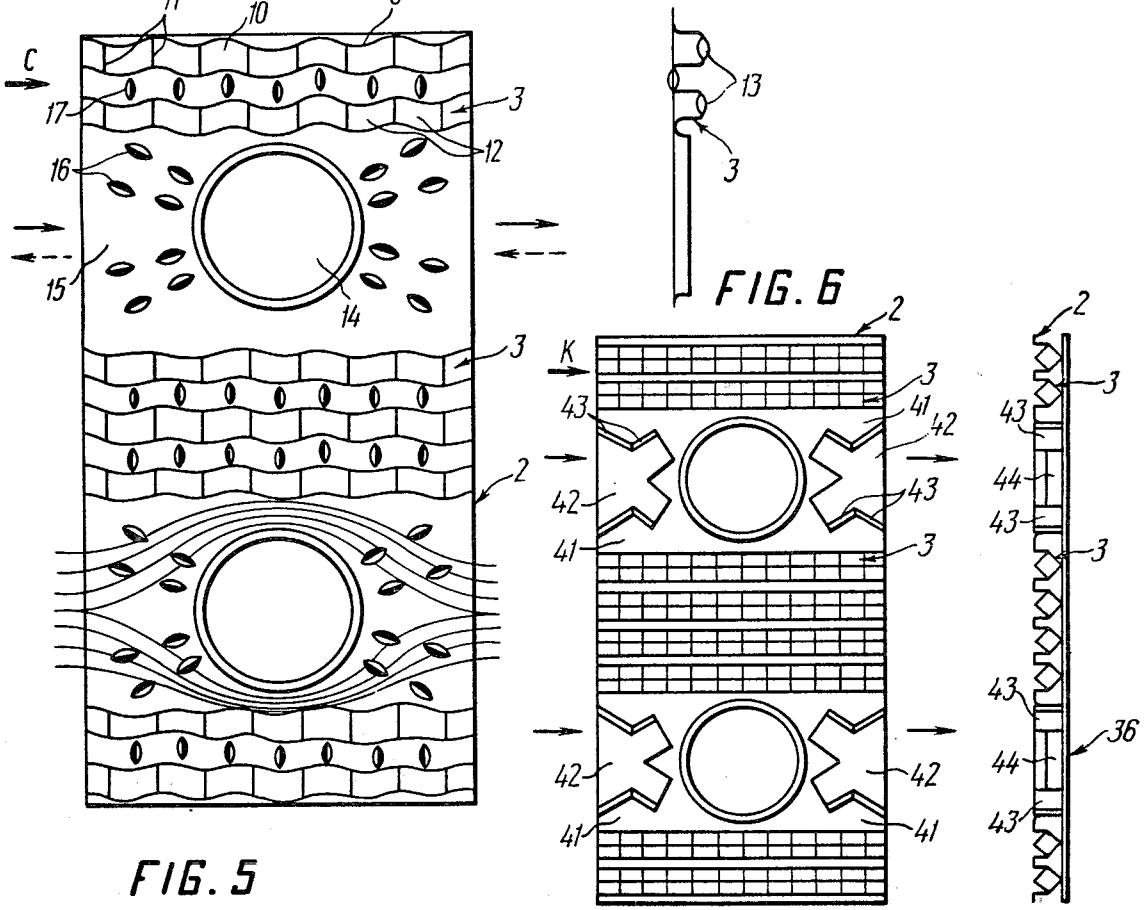
FIG. 5 is a plan view of a rib of a heat exchanger, representing another embodiment of the invention.
FIG. 6 is a view along arrow line "C" in FIG. 5.
FIG. 20 is a plan view of yet another embodiment of a rib of a heat exchanger.
FIG. 21 is a view along arrow line "K" in FIG. 20.

There is shown in FIG. 5 of the appended drawing a rib 2 with corrugations 3 having sinuous side walls 9. There are cut through the apexes 10 of the corrugations 3 transverse slits 11, the portions 12 of each corrugation 3 between these slits being offset relative to one another in a direction transverse of the corrugation 3, whereby flow passages 13 (FIG. 6) are formed for the flow of the gaseous medium. These passages 13 are oval-shaped in cross-section. In this embodiment the rib 2 has two apertures 14 by which the rib is received about two tubes. The plain portions 15 of the rib 2 intermediate of the corrugations 3 have similar slits 16 cut therethrough, the slits extending transversely of the flow of the fluid washing the tube (not shown). The edges of each slit 16 are bent away in opposite directions from the plane of the rib 2. The slits 16 extend substantially radially of the respective aperture 14, and, consequently, of the tube. To attain maximum turbulization of the flow of the medium and interruption of the boundary layer across maximum areas of the rib 2, the slits 16 are arranged transversely of the lines of the flow of the medium washing the tube, the lines being shown with thin solid lines in FIG. 5.

The edges of the slits 16 are bent away to both sides of the plane of the rib 2 by about 1 mm (the rib spacing being 3 to 4 mm) in the following order: when one slit 16 has its right-hand edge bent in the direction of the corrugations 3 and its left-hand edge bent to the opposite side of the plane of the rib 2, the adjacent slits 16 have their left-hand edges bent in the direction of the corrugations, while the right-hand edge of each one of these adjacent slits 16 is bent to the opposite side of the plane of the rib 2. Such alternation of the direction of the bending of the edges provides for uniform turbulization of the flow of the medium, irrespectively of its direction.

To provide for rigidity of the rib 2, for its tight fitting over the tube and for better washing of the tube by the flow of the medium, there is left intermediate of the aperture 14 and the slits 16 adjacent thereto a plain solid annulus 4 to 5 mm wide. The surface of the rib 2 at the centre of the plain portions 15 intermediate of the corrugations 3 is likewise plain and devoid of the slits, in order to reduce the flow resistance at these portions of the rib 2, to increase the flow of the medium along these portions and to minimize the "dead" zone produced by the flow encountering the tube, so as to enhance heat transfer.

The length of the slits 16 and the spacing thereof should be as small as possible, e.g., 2 to 3 mm, particularly, when the dimensions of the rib 2 itself are small, so as to have as many as possible such slits in the surface of the rib 2, because the more frequent is the interruption of the boundary layer of the flow, the more effective is heat transfer.

The portions of the rib 2 in the valleys between the corrugations 3 have slits 17 made therein transversely of the flow of the medium, the edges of each slit 17 being bent away in opposite directions from the plane of the rib 2. The slits 17 are intended to intensify heat transfer at the surface of the rib 2 between the corrugations 3. To maintain adequate rigidity of the rib 2, the slits 17 are staggered with respect to the slits 11 and are arranged at the same spacing from one another, as the slits 11.

In the hereinabove described embodiments of the present invention the effectiveness of heat transfer on the part of the gaseous medium is stepped up predominantly at the apexes 5 (FIG. 3) and 10 (FIG. 5) of the corrugations 3. The side walls 9 and 4 (FIG. 3), respectively, remain solid, and the intenseness of heat transfer at these walls is increased solely on account of turbulization of the flow, as it is interrupted across the slits. Therefore, ribs 2 of the abovedescribed kinds are advisable in cases where the spacing "t" of the ribs 2 is relatively small, e.g. as small as 2 to 3 mm.

In the abovedescribed embodiment where the compactness of the surface is stepped up 2.2 times the total heat transfer factor of the gaseous medium is increased by at least 30 percent, owing to the interruptions of the apexes 10 of the corrugations 3. The last-mentioned increase may be even greater, should the width "c" of the corrugations 3 (FIG. 4) be in excess of the spacing "t" of the ribs 2; however, in this case the gain in the compactness is bound to be somewhat smaller. Optimal relationship of these dimensions is selected in each particular case in compliance with design features and production facilities. In any case, with the same spacing "t" of the ribs 2 and the same degree of the ribbing, the dimensions of the herein disclosed heat exchanger are reduced about 2.2 times, as compared with the known heat exchanger with solid plain ribs, whereas the weight is reduced by approximately 25 percent.

Figure 7:
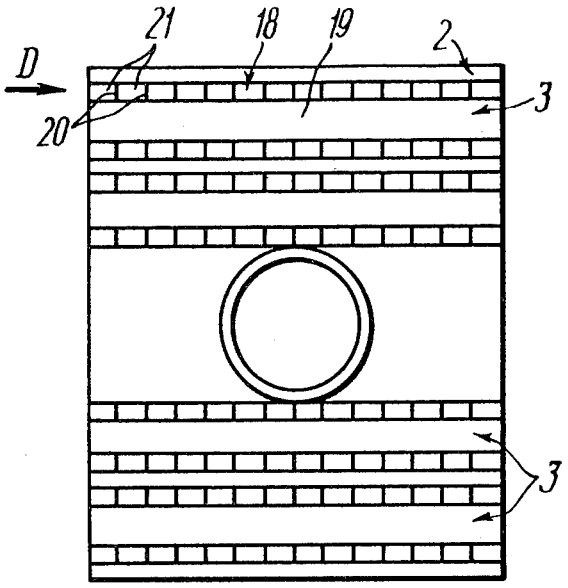
FIG. 7 is a plan view of another embodiment of a rib of a heat exchanger.
Figure 8:
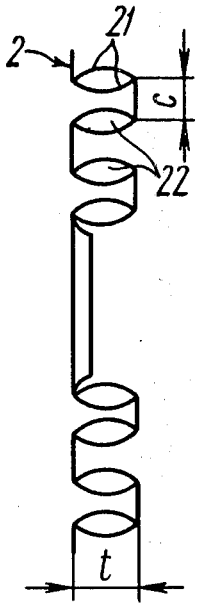
FIG. 8 is a view along arrow line "D" in FIG. 7.

There is illustrated in FIG. 7 of the appended drawings a rib 2 with corrugations 3 having a width "c", disposed to one side of the plane of the rib 2. The corrugations 3 have side walls 18 and apexes 19. There are cut through the side walls 18 slits 20 subdividing these walls into portions 21 (FIG. 8) offset relative to one another. As the portions 21 of the side walls 18 are thus offset, each said portion becomes curving, whereby in this case the flow passages 22 afforded to the medium at the areas of the slits 20 are of semi-oval shape; however, they may alternatively be of another shape, e.g. triangular or trapezoidal, which generally depends on the production facilities.

In the presently described embodiment the portions 21 of the walls 18 of the corrugations 3 are offset relative to one another by a distance smaller than the width of the corrugations 3, so that these portions do not contact the side walls 18 of the adjacent corrugations 3. However, these portions may be offset by a distance equalling "c", to contact the adjacent corrugations. In this manner the compactness of the heat exchanger is stepped up. In such cases from the point of view of the compactness, of the effectiveness of heat transfer and of the value of hydraulic resistance either a semi-oval or a circular shape is optimal.

The heat exchange surface of such rib 2 is increased, owing to the curving of the portions 21 of the side walls 18. With the same width "c" of the corrugations 3, the effectiveness of heat transfer and the compactness of the surface of heat exchange of the ribs 2 of the last-described structure are greater than those of the ribs 2 having the slits 11 (FIG. 5) made in the apexes 10 of the corrugations 3.

In cases where the width "c" of the corrugations 3 (FIG. 8) equals the spacing "t" of the ribs 2 the compactness of the heat exchange surface of the ribs 2 with the slits 20 through the side walls 18 of the corrugations 3 is stepped up about 2.5 times, as compared with plain ribs arranged with the same spacing "t", while the factor of heat transfer by the gaseous medium is increased by approximately 70 percent. This amounts to the overall dimensions of the heat exchanger with the same ribbing degree being reduced approximately 2.5 times, and the weight of the apparatus being reduced by about 35 percent.

It is expedient to have the ribs 2 of the kind with the slits 20 through the side walls 18 of the corrugations 3, when the spacing of the ribs 2 is relatively great, e.g. as great as 4 to 6 mm, in which case the surface of the side walls 18 constitutes a major part of the entire surface of the ribs 2.

Figure 9:
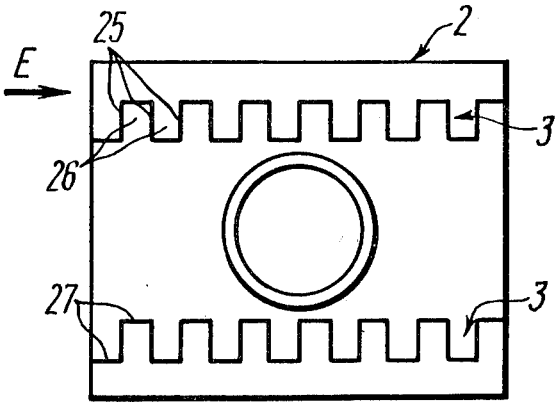
FIG. 9 is a plan view of still another embodiment of a rib of a heat exchanger.

There is shown in FIG. 9 of the appended drawings a rib 2 with corrugations 3 (FIG. 10) of a width "c", disposed to one side of the plain of the rib 2. The corrugations 3 have side walls 23 and apexes 24 in which there are made through-going slits 25 sub-dividing the surface of each corrugation 3 into portions 26 offset relative to one another so that each portion 26 is left with a single side wall 27 perpendicular to the plane of the rib 2. All the side walls 27 are disposed to one side of the plane of the rib 2.

This perpendicularity of the side walls 27 relative to the plane of the rib 2 is responsible for the ribs 2 being retained on the tube (not shown) with their spacing equalling "t".

To step up the compactness of the structure, the edges 28 of the rib 2, parallel with the corrugations 3, are bent by a distance equalling the spacing "t". With several corrugations 3 being arranged at both sides of the tube, these bent edges 23 constitute each the side wall of the successive corrugation and preferably have in this case an interrupted structure.

In the presently described embodiment the apexes 24 of the corrugations 3 and their side walls 23 are rectilinear, and, consequently, the compactness offered by the surface of the ribs 2 is somewhat smaller than in the previously described embodiment, on the other hand, the last-described rib 2 is more simple in manufacture. Its use is advisable with relatively small degrees of ribbing and relatively small dimensions of the ribs 2, their spacing "t" being from 3 mm to 6 mm. The width "c" of the corrugations 3 should be equal to about one half of the spacing "t", i.e. to 1.5 mm–3.0 mm. The spacing "e" of the side walls 23 of the adjacent corrugations 3 is preferably also within a range from 1.5 mm to 3.0 mm. These relatively great values of "c" and "e" enable to accommodate a greater number of corrugations 3 on the rib 2, and, consequently, to step up the compactness, which is of paramount importance with relatively small dimensions of the ribs 2.

Figure 10:
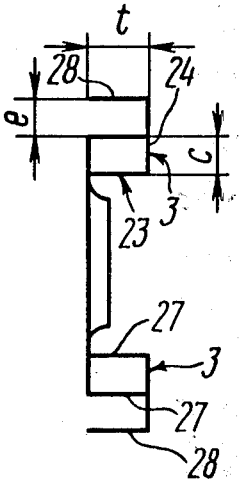
FIG. 10 is a view along arrow line "E" in FIG. 9.

With the same spacing of the ribs 2 and the same ribbing degree the rib structure illustrated in FIGS. 9 and 10 enables to reduce the overall dimensions of a heat exchanger about two times and to reduce the weight by about 30 percent, as compared with the known heat exchanger with plain ribs.

Figure 12:
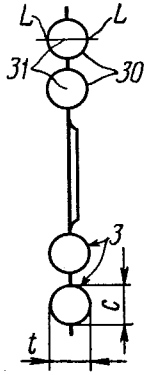
FIG. 12 is a view along arrow line "F" in FIG. 11.
Figure 11:
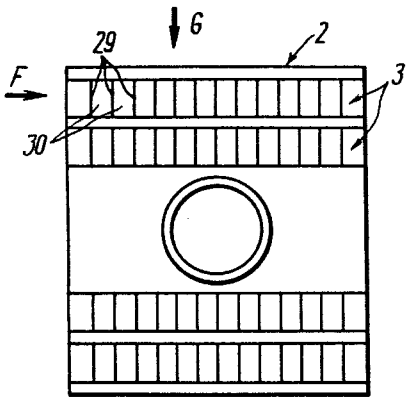
FIG. 11 is a plan view of still another embodiment of a rib of a heat exchanger.
Figure 13:
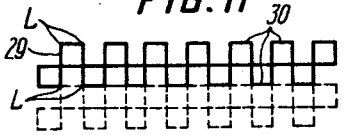
FIG. 13 is a view along arrow line "G" in FIG. 11.

FIG. 11 of the appended drawings shows a rib 2 with corrugations 3 having made therethrough transverse through-going slits 29 passing through the apexes and side walls of the corrugations and dividing the surface of the corrugations into portions 30. The corrugations 3 are arranged to both sides of the plane of the rib 2. The portions 30 (FIG. 12) are staggered relative to one another in a direction perpendicular to the plane of the rib 2 and afford passages 31 for the flow of the medium, which passages in the presently described embodiment are circular in cross-section at the areas of the slits 29. This presently-described rib 2 offers more effective heat transfer than the previously described embodiments, because, firstly, all the walls of the corrugations 3 are interrupted, and the flow leaps off along all the corrugated part of the rib 2, and, secondly, the spacing of the adjacent corrugations 3 can be positively minimized, depending as it does solely by the strength of the material of the rib 2 at its portions in the valleys intermediate of the corrugations 3. In fact, the entire corrugated part of the rib 2 is in this case made up by the short portions 30 (FIG. 13).

The compactness of the surface is in this embodiment somewhat lower than that offered by the ribs 2 having their corrugations 3 arranged to one side of the plane of the rib 2, since this compactness is increased in comparison with a plain rib solely on account of the curving of the portions 30, these portions 30, when they are offset to both sides of the plane of the rib 2, occupying a greater space, than they do when they are offset to one side. In this embodiment the maximum attainable compactness in combination with highly effective heat transfer are ensured when each portion 30 (FIG. 12) is of either semi-circular or semi-oval shape, the ribs 2 contacting one another at points "L", as can be seen in FIG. 13.

The ribs of this kind are preferably used with relatively great spacing "t", as great as 6 mm to 8 mm, e.g. for media with a high impurity content, as well as in cases where the requirements to the compactness of the apparatus are not particularly strict, but weight reduction is essential.

With the same degree of the ribbing and the same spacing "t" of the ribs 2 the dimensions of a heat exchanger with the ribs 2 of the last-described structure are reduced about 1.6 times, as compared with the known heat exchanger with plain solid ribs, while the weight is reduced by 50 percent.

Figure 15:
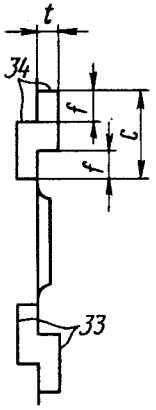
FIG. 15 is a view along arrow line "H" in FIG. 14.
Figure 14:
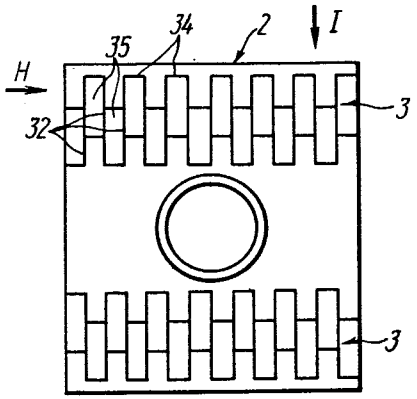
FIG. 14 is a plan view of still another embodiment of a rib of a heat exchanger.
Figure 16:
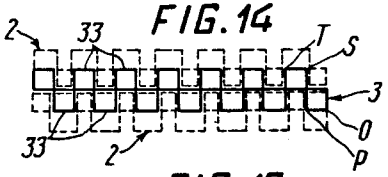
FIG. 16 is a view along arrow line "J" in FIG. 14.

FIG. 14 of the appended drawings illustrates a rib 2 with corrugations 3 arranged to both sides of the plane of the rib 2. The corrugations 3 have through-going slits 32 passing through their apexes 33 (FIG. 15) and through their side walls 34 and subdividing the surface of the corrugations 3 into portions 35 (FIG. 14). The side walls 34 (FIG. 15) of the corrugation 3 are perpendicular to the plane of the rib 2, these side walls 34 of the adjacent portions 35 being staggered relative to one another in a direction parallel to the plane of the rib 2. The extent "f" of this displacement of the side walls 34 is about one third of the width "c" of the corrugation 3. In the heat exchanger with the ribs 2 of this structure the apexes 33 of the corrugations 3 lie in the planes of the adjacent ribs 2, as can be seen in FIG. 16, and contact these adjacent ribs 2 at points O, P, S, T. In this manner it is possible to step up the compactness of the heat exchanger, as compared with the previously described embodiment, since in this case the spacing "t" of the ribs is in fact reduced to one half. Moreover, the relative displacement of the side walls 34 of the adjacent portions 35 ensures their interrupted structures and, consequently, the high effectiveness of heat transfer at these side walls. As a result, all the side walls 34 and the apexes 33 of the corrugations 3 acquire an interrupted structure, the same as in the previously described embodiment, the effectiveness of heat transfer being as high, while the compactness of the surface is considerably greater. However, the manufacture of the heat exchanger becomes more complicated. It is advisable to use the ribs 2 of the presently described embodiment in heat exchangers that are to meet strict requirements both as far as their compactness and weight are concerned, the spacing "t" of the ribs being relatively small (3 to 4 mm) and the degree of the ribbing being comparatively high.

As compared with a heat exchanger with plain solid ribs, having the same rib spacing "t" and the same ribbing degree, the overall dimensions of the last-described heat exchanger are reduced approximately 2.2 times, while the weight is reduced by about 50 percent.

Figure 18:
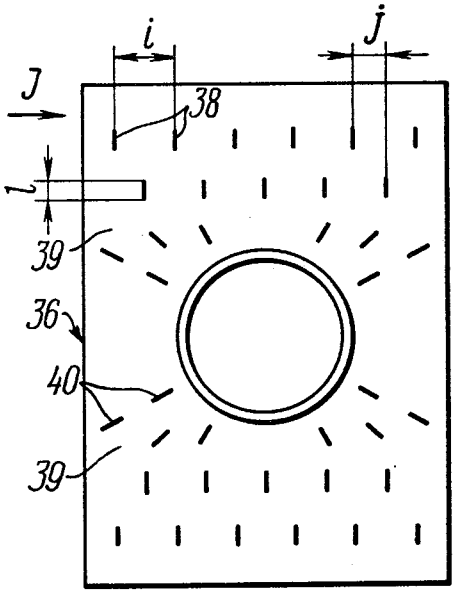
FIG. 18 is a plan view of the intermediate plate.
Figure 17:
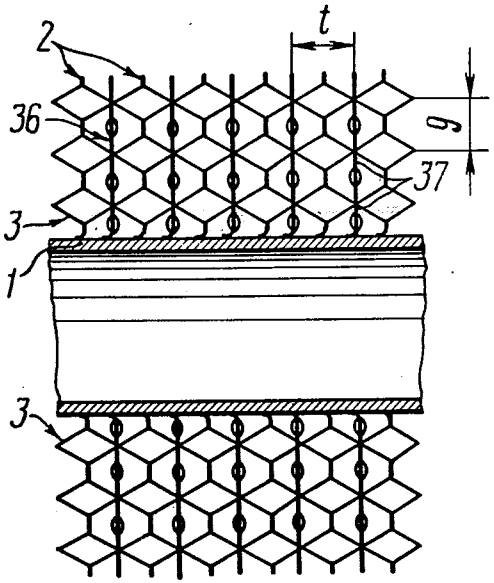
FIG. 17 is a longitudinally axial sectional view of a portion of a tubular heat exchanger having ribs representing another embodiment of the present invention.

There is depicted in FIG. 17 of the appended drawings a heat exchanger wherein the ribs 2 fitted over the tube 1 adjoin one another through an intermediate plate 36. The plates 36, the same as the ribs 2, are tightly fitted over the tube 1. There are made in the portions 37 of each plate 36, intermediate of the side walls of each corrugation 3, slits 38 extending transversely of the flow of the medium and spaced from one another by a spacing "i", the edges of each slit 38 being bent away in opposite directions from the plane of the plate 36. In this way heat transfer at the surface of the plate is intensified. The length "l" of the slits 38 (FIG. 18) is determined in accordance with the value "g" (FIG. 17) of the spacing of the side walls of the corrugations 3 and preferably equals about one half of this spacing, i.e. $l = J/2$.

The edges of the slits 38 are bent away from the plane of the plate 36 by about 1.0 mm, with $t/2 = 3.0$ to 4.0 mm. The slits 38 (FIG. 18) are spaced from one another by about 3.0 to 4.0 mm and are staggered in the adjacent rows by a distance "j" equalling "i/2", to ensure adequate rigidity of the intermediate plate 36. Apart from intensifying heat transfer, the slits 38 establish fluid communication between all the inter-rib passages, thus rendering the performance of the heat exchanger unaffected by clogging of some portions of the inter-rib passages.

The provision of the plate 36 enables to step up the compactness of a heat exchanger having the ribs 2 of which the corrugations 3 are disposed to both sides of the plane of the rib 2, and that with retaining one of the main advantages — the simplicity of manufacture of the ribs 2. Furthermore, the intermediate plate 36 reliably retains the ribs 2 on the tube 1 with the required spacing "t".

The plate 36 is preferably half as thick as the rib 2, to reduce the weight of the heat exchanger. With the intermediate plate 36 being held in firm contact with the rib 2 (FIG. 17), heat is transmitted from the corrugated portions of the ribs 2 to the tube 1 partially through the plate 36, which steps up the effectiveness of heat exchange.

Figure 19:
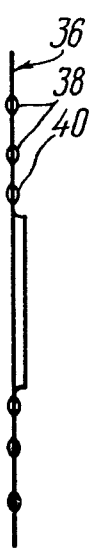
FIG. 19 is a view along arrow line "J" in FIG. 18.

The portions 39 (FIG. 18) of the plate 36, corresponding to the portions of the ribs 2 between the corrugations 3, have slits 40 cut therethrough transversely of the flow of the medium washing the tube 1, the edges of each slit being bent away in opposite directions from the plane of these portions 39, as can be seen in FIG. 19. The slits 40 extend substantially radially of the tube 1, similarly to the slits 16 (FIG. 5) in the rib 2, as it has been described hereinabove, i.e. transversely of the flow lines of the medium washing the tube. The slits 40 intensify heat transfer at the areas of the plate 36, adjoining the tube.

FIG. 20 of the appended drawings illustrates a rib 2 with corrugations 3 disposed to one side of the plane of the rib 2. The portions 41 of the rib 2 intermediate of the corrugations 3 at both sides of the tube have slits 42 made therein, the edges 43 of each slit being bent away in the same direction, as the corrugations 3 (FIG. 21) to the height of the corrugations 3. The bent away edges 43 of the slits 42 define with the respective intermediate plate 36 guiding passages 44 for the flow of the fluid, the shape of these passages being illustrated in FIG. 20.

The guiding passages 44 deflect the flow of the medium within the passages intermediate of the ribs 2 and direct the greater part of this flow directly upon the tube 1 and onto the portions of the intermediate plates 36 adjoining the tube and contacting the rib 2. In this manner there is intensified heat transfer at the areas of the heat exchange surface, which most effectively transfer the heat to the medium flowing through the tube 1.

Moreover, the bent away edges 43 of the slits 42 increase the heat transfer surface of the heat exchanger at the areas adjoining the tube 1 and hence being most effective in heat transfer.

All the abovedescribed embodiments of the present invention in the various structures of the ribs 2 offer effective heat exchange surfaces and yield higher values of hydraulic resistance at the same velocities of the gaseous fluid, than heat exchangers with plain plates. Therefore, to maintain the same power capacity employed for pumping the medium through the heat exchanger, the calculation velocity of this medium through the herein disclosed heat exchanger should be lower, than the velocity of the medium flowing through the hitherto known heat exchanger. And it is at this reduced velocity that the factor of heat transfer by the gaseous medium has proved to be higher, which is characteristic of every effective heat exchange surface.

The reduction of the rate of flow of the gaseous medium is provided for by increasing the frontal sectional area of the heat exchanger, which enables to reduce the depth of the apparatus longitudinally of the flow of the gaseous medium and, therefore, to reduce the pressure losses. These techniques aimed at reducing the gas velocity and the depth of the apparatus to maintain the same power capacity employed for pumping the fluid are commonly known in connection with effective heat exchange surfaces.

What we claim is:

1. A tubular heat exchanger comprising a tube adapted for conveying a first fluid medium, and a plurality of adjoining fins mounted on said tube perpendicularly to the axis thereof and uniformly spaced longitudinally therealong, each said fin comprising a plate having a length and width and including a planar portion surrounding said tube and lines of corrugations extending transversely across the entire width of the fin at opposite sides of said tube, said lines of corrugations extending parallel to one another in the direction of flow of a second fluid medium extending perpendicular to the axis of the tube, each said corrugation including opposite side walls extending perpendicularly from said plate in spaced parallel relation, said corrugations including front walls connecting the side walls, the corrugations alternating in each line such that the front wall of one corrugation projects axially forwardly as an apex portion away from the plane of said plate and the front wall of the adjacent corrugation projects axially rearwardly as an apex portion towards the plane of said plate, said forwardly and rearwardly projecting front walls having substantially equal length, said apex portions of the adjoining corrugations defining passages for the flow of said second fluid medium through the corrugations, said corrugations being disposed at one side of the plane of said plate such that the forwardly projecting walls of the corrugations of one fin abut against the rearwardly projecting walls of the corrugations of the adjoining fin to maintain said planar portions of said fins in spaced relation along said tube, said corrugations each having a height between said side walls which is substantially equal to the spacing between the planar portions of adjoining fins.

2. A heat exchanger as claimed in claim 1 wherein said front walls are angulated and said passages are diamond shape.

3. A heat exchanger as claimed in claim 1 wherein said front walls are rounded.

4. A heat exchanger as claimed in claim 1 wherein a plurality of lines of corrugations extend on opposite sides of said tube in each plate, said corrugations constituting about 50% of the surface area of said plate.

* * * * *